United States Patent [19]

Maros

[11] Patent Number: 4,647,128

[45] Date of Patent: Mar. 3, 1987

[54] ELECTRICAL CONNECTOR SYSTEM WITH RELEASABLE LATCHING

[75] Inventor: Ronald R. Maros, Itasca, Ill.

[73] Assignee: Cooper Industries, Inc., Houston, Tex.

[21] Appl. No.: 818,613

[22] Filed: Jan. 13, 1986

[51] Int. Cl.[4] ..... H01R 13/629

[52] U.S. Cl. ..... 339/61 M; 339/91 R

[58] Field of Search ..... 339/91 R, 59 R, 59 M, 339/61 R, 61 M

[56] References Cited

U.S. PATENT DOCUMENTS

| | | | |
|---|---|---|---|
| 2,923,909 | 2/1960 | Moorey | 339/61 R |
| 3,368,181 | 2/1968 | Gimpel | 339/61 R |
| 3,594,696 | 7/1971 | Witek, Jr. | 339/91 R |
| 3,711,816 | 1/1973 | Schumacher | 339/91 R |
| 4,002,389 | 1/1977 | Mammel | 339/91 R |
| 4,526,431 | 7/1985 | Kasukawa | 339/91 R |

*Primary Examiner*—John McQuade

*Attorney, Agent, or Firm*—Fitch, Even, Tabin & Flannery

[57] ABSTRACT

An electrical connector system with releasable latching. The system includes a plug having an insulative body carrying at least one first terminal element connected to a conductor extending from the plug. The system also includes a receptacle having a body of insulative material defining a cavity with an open end for receiving the plug and having at least one second terminal element aligned for mating engagement with the first terminal element when the plug is received in the receptacle. The plug includes a locking ear extending laterally relative to the axial direction of the plug with the receptacle having a cantilever latch extending alongside the plug and with the free end of the latch positioned past the locking ear. The latch has a window for receiving the ear to lock the plug to the receptacle. The latch is resilient and deflectable outwardly from a locking position wherein the latch holds the ear to a release position wherein the latch is disposed out of the path of the ear. The receptacle further includes a receiver for receiving the latch in an interference fit to releasable hold the latch in its release position so that the plug and receptacle can be disassociated without interference from the latch.

14 Claims, 12 Drawing Figures

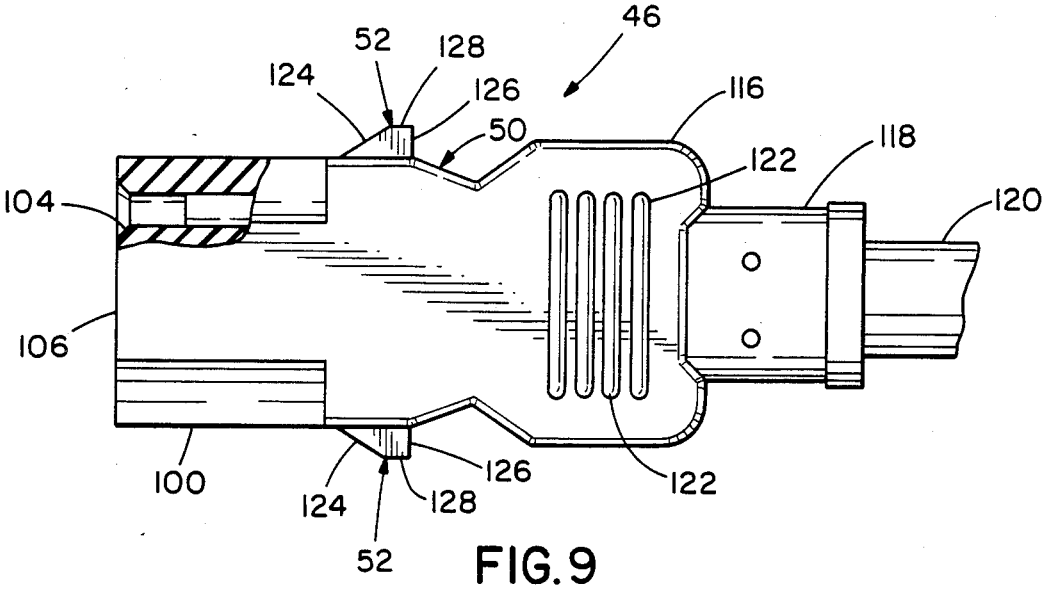
FIG. 9
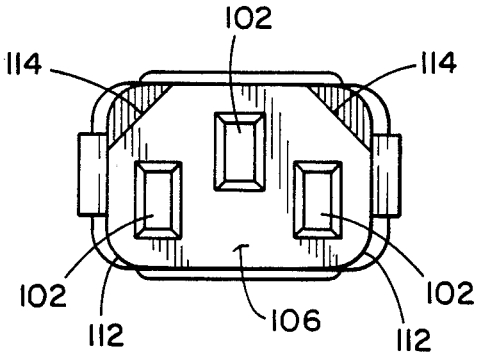
FIG. 10
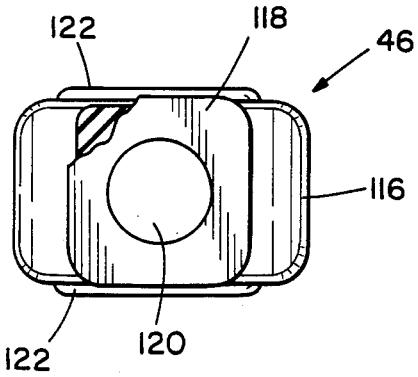
FIG. 11
FIG. 12
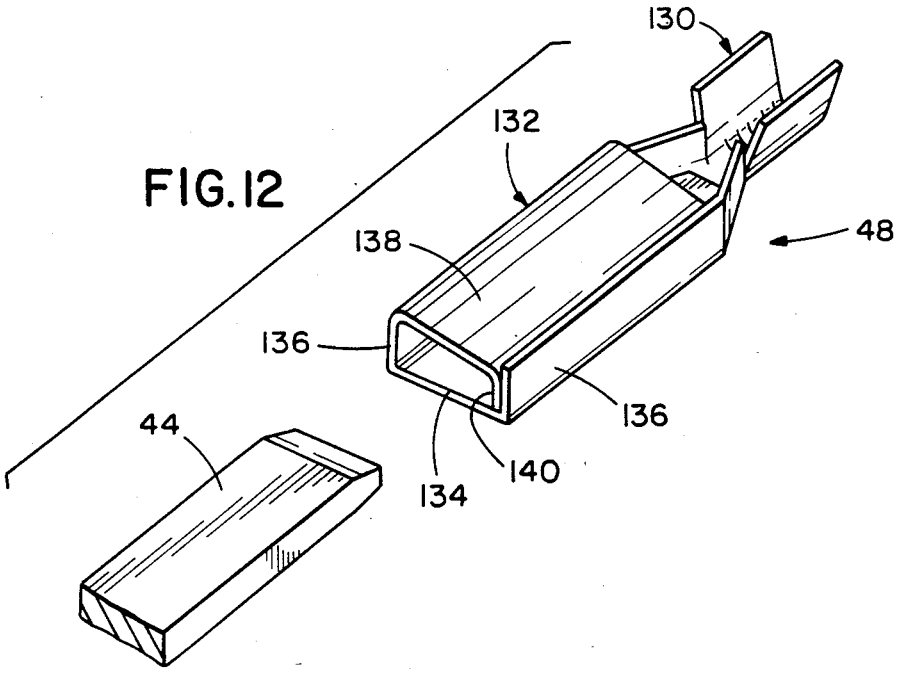

ELECTRICAL CONNECTOR SYSTEM WITH RELEASABLE LATCHING

The present invention relates to electrical connection apparatus and, more specifically, to a connector system of the type including a plug and a receptacle for receiving the plug.

BACKGROUND OF THE INVENTION

One cost efficient way of manufacturing electrical power connectors is to mold the plastic insulative body about the terminal elements to be held by the plug. When the metallic terminal element to be held includes a spring component, for example, of the type found in a female disconnect, it is advisable to mold the insulative body of a relatively soft and low tensile strength material such as polyvinyl chloride (PVC) so that the body will not unduly interfere with operation of the spring component. Excessive interference with the spring component could make the force necessary to mate the connector with another connector unacceptably high.

It is also desirable,to provide latching means on the connectors to prevent their unintentional disassociation. The most cost efficient method of providing a latching component is to mold it as an integral part of the connector insulative body. Examples of prior art connector systems (including a plug and a receptacle) are shown in FIGS. 1 and 2. In FIG. 1, the plug 20 includes laterally protruding ears 24 having leading ramp surfaces for bowing apart side walls 26 defining a cavity in a receptacle 28 so that the ears can be received in windows 29. The trailing surfaces 30 of the ears extend at a more severe angle but function also to cam apart the side walls 26, upon application of a greater pull out force than the insertion force, to release the plug from the receptacle.

In FIG. 2, the plug 32 has rockable latch arms 33 for engaging ears extending laterally from the outside of the receptacle shroud 34. This configuration requires that both latch arms be concurrently moved to their release positions to permit removal of the plug. While both the FIG. 1 and FIG. 2 designs operate satisfactorily when the plug and receptacle are molded of relatively hard plastic, such as nylon, they would not be acceptable if one of the bodies was molded of the relatively soft, low tensile plastic. If the plug 20 were formed of PVC, the surfaces of the locking ear could be damaged when unmating the plug. Upon repeated connection and release, it is likely the ears would be torn or wiped away. With respect to the plug configuration of FIG. 2, PVC is too flexible to be used for such rockable arms.

SUMMARY OF THE INVENTION

Among the several aspects and features of the present invention may be noted the provision of an improved electrical connector system with releasable latching. The plug body is formed of a relatively soft, low tensile strength material so not to interfere with operation of the metallic disconnects which it holds, but has an integrally formed latching component which provides firm locking. The receptacle housing has integrally formed latch components and means for maintaining the latch components in their release positions and also for protecting the latch components when in their locking positions. The connector system of the present invention is reliable in use, has long service life, can undergo repeated plugging and unplugging without damage to the latching components, and is relatively simple and economical to manufacture. Other aspects and features of the present invention will be in part apparent and in part pointed out hereinafter in the specification and accompanying drawings.

The electrical connector system embodying various features of the present invention includes a plug having an insulative body carrying several first terminal elements connected to conductors extending from the plug, and a receptacle with an insulative body defining a cavity having an open end for receiving the plug with the receptacle having a like number of second terminal elements aligned for mating engagement with their corresponding first terminal elements when the plug is received in the receptacle. The plug and receptacle have latch components for holding the plug in the receptacle. The plug includes a locking ear extending laterally relative to the axial direction of the plug while the receptacle has a cantilever latch extending alongside the plug and with the free end of the latch positioned past the locking ear. The latch has a window receiving the ear to lock the plug to the receptacle. The latch is resilient and deflectable outwardly from a locking position to a release position and the receptacle includes a shroud having an opening for receiving the latch in an interference fit to hold the latch in its release position so that the plug and receptacle, once mated, can be disassociated without interference from the latch.

BRIEF DESCRIPTION OF THE DRAWINGS

FIG. 9 is a plan of a plug of the connector system of FIG. 3;

FIG. 10 is a front elevational view of the plug of FIG. 9;

FIG. 11 is a rear elevational view of the plug; and

FIG. 12 is a perspective view of one of the female terminal elements held in the body of the plug.

Corresponding reference numbers indicate corresponding components in FIGS. 3–12 of the drawings.

DESCRIPTION OF THE PREFERRED EMBODIMENT

Figure 1:
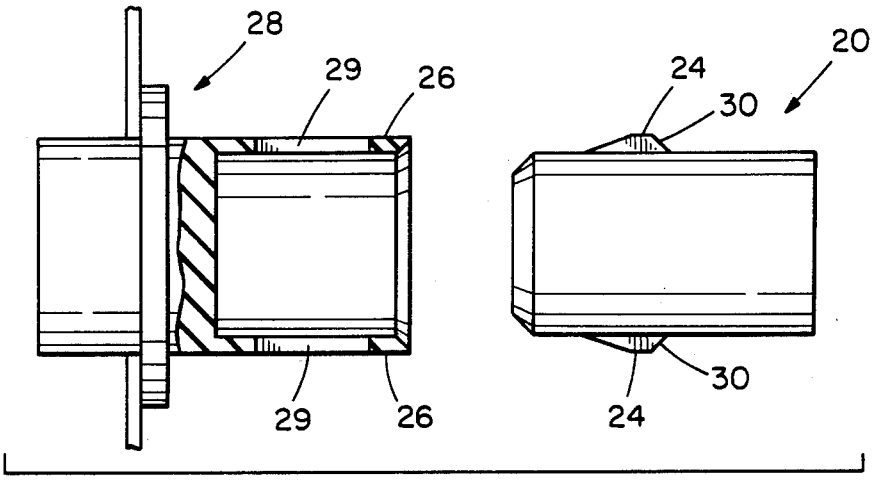
PRIOR ART FIG.1
FIG. 1 is a side elevational view of a prior art electrical connector system with certain components broken away to expose other components.
Figure 2:
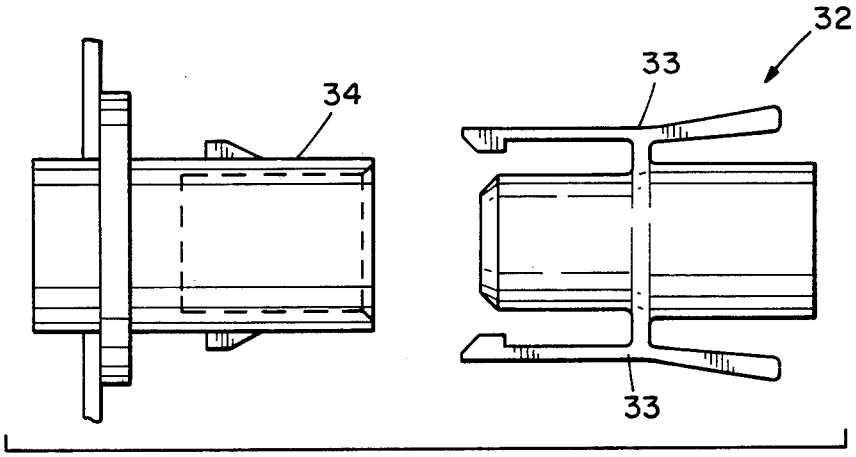
PRIOR ART FIG.2
FIG. 2 is a side elevational view of another prior art electrical connector system.
Figure 3:
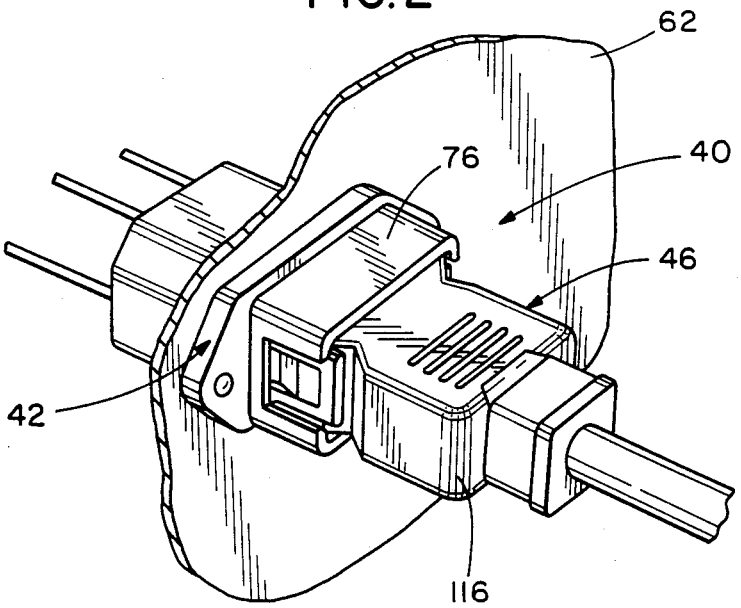
FIG. 3 is a perspective view of an electrical connector system, embodying various features of the present invention, mounted on a panel.

Referring now to the drawings, an electrical power connector system of the present invention is generally indicated by reference character 40 in FIG. 3. The connector system 40 includes a power receptacle 42, best shown in FIGS. 4–8, for holding a plurality of metallic terminal elements in the form of metallic male disconnects or pins 44 of rectangular cross section, an example of which is shown in FIG. 12. The connector system 40 also comprises a power plug 46, best shown in FIGS. 9–11, holding a plurality of metallic terminal elements in the form of female disconnects or receivers 48 of the type shown in FIG. 12. As will be discussed more fully hereinafter, such female disconnects have spring components which are resiliently deformed upon insertion of a pin 44. The plug 46 includes an insulative body 50 molded about the receiver 48 and made of a relatively soft, low tensile strength plastic material such as PVC, neoprene, or the like so as not to unduly interfere with operation of the spring components. If the body 50 were molded of a hard plastic, such as nylon, the spring components could not move freely resulting in high insertion force. Extending laterally from the body 50 are a pair of integrally formed, diametrically opposed locking ears 52.

More specifically, the receptacle 42 includes a body 54 of insulative material defining a cavity 56 having an open end 58 for receiving the plug 46. The body is preferably molded of a relatively hard plastic, such as nylon, Noryl (a trademark of General Electric Co. for synthetic thermoplastic resins) or the like. The receptacle body 54 includes a peripheral mounting flange 59 having apertures 60 for receiving fasteners to mount the receptacle in an opening in a panel 62. Extending rearwardly of the flange 59 is a housing 63 formed of an upper wall 64, a lower wall 66, side walls 68 and an end wall 70. The end wall 70 has a trio of spaced, offset openings 72 for receiving the pins 44 which are held by means of welding to the surrounding material of the end wall, or by gluing. Isolation barriers 74 are provided between the various openings 72.

Figure 5:
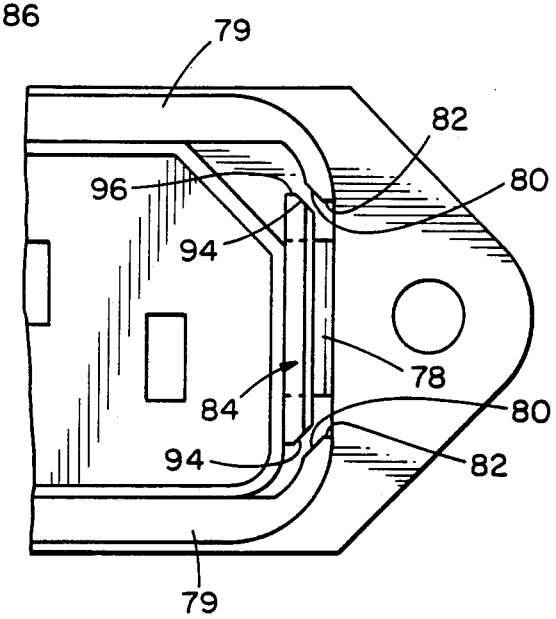
FIG. 5 is an enlarged partial front elevational view depicting the latch, shown in FIG. 4 in its locking position.

Extending forwardly of the flange 59 is a shroud 76 partially defining the cavity 56 and terminating at the open end 58. The shroud has a pair of openings 78 to substantially divide the shroud into a pair of U-shaped components 79. The portion of each shroud component defining each side of one of the openings 78 has an inner guide surface 80 adjoining a bearing surface 82, as best shown in FIG. 5. Disposed inwardly of each opening 78 and aligned therewith is a cantilever latch 84 having one end connected adjacent the flange 59 and a distal end cross member 86 terminating at the open end 58. Besides the cross member 86, the latch includes an upper and a lower arm 90 interconnecting cross member 86 with the flange 59 and defining with the cross member 86 a window 92 for receiving one of the locking ears 52 of the plug 46. Each upper arm and lower arm 90 has a cam surface 94 facing a corresponding guide surface 80, and an adjoining bearing surface 96. Each opening 78 is sized to releasably receive its corresponding latch in an interference fit.

Figure 4:
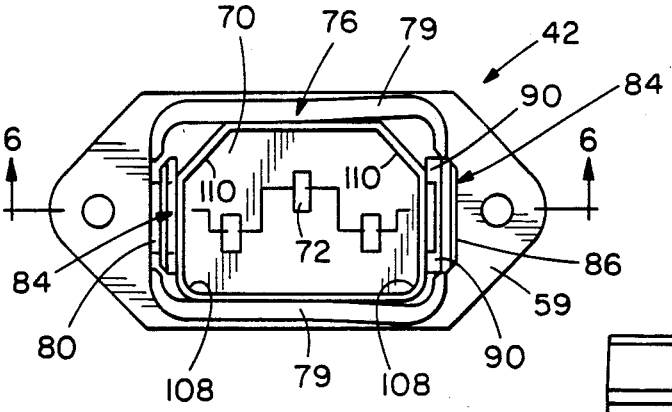
FIG. 4 is a front elevational view of a receptacle of the electrical connector system of FIG. 3 showing a pair of cantilever latches with one latch in a locking position and the other latch maintained in a release position.
Figure 6:
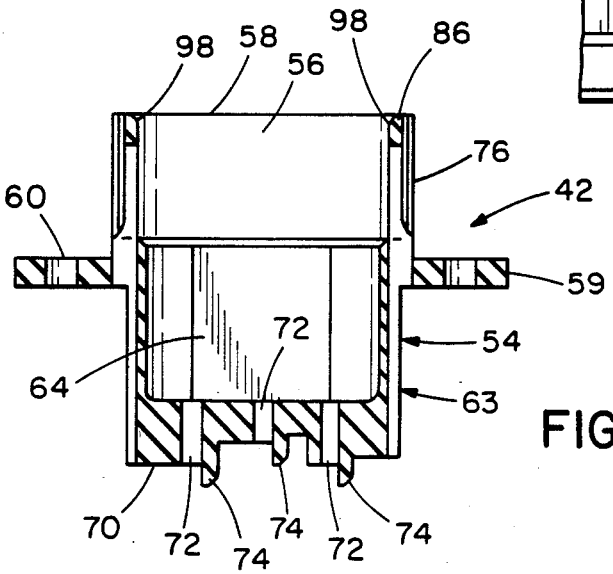
FIG. 6 is a sectional view of the receptacle taken generally along line 6—6 of FIG. 4.
Figure 7:
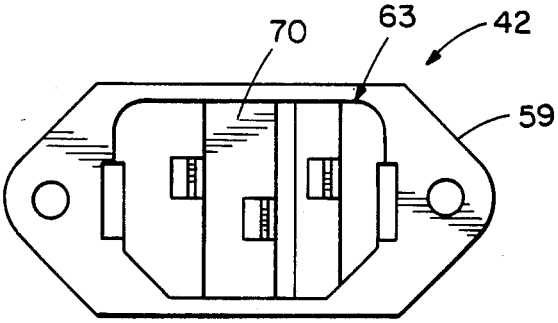
FIG. 7 is a rear elevational view of the receptacle.
Figure 8:
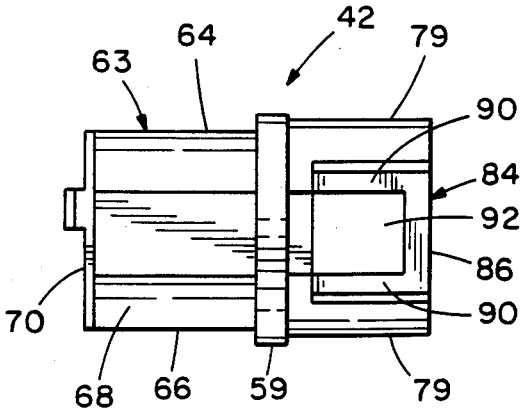
FIG. 8 is a side elevational view of the receptacle.

Referring to FIG. 4, each latch 84 is resilient and deflectable outwardly from a locking position wherein the latch is in position to hold an ear 52 of the plug 46, and a release position wherein the latch is disposed out of the path of its corresponding ear 52 as the plug is removed from (or inserted into) the cavity 56. The left latch shown in FIG. 4 and the latch shown in FIG. 5 are in their locking positions, while the right latch shown in FIG. 4 is in its release position. The inner surface 98 of each distal end cross member 86 is rounded to enable the user to hook a fingernail (or use a hand tool, such as a screwdriver) under the cross member 86, as best shown in FIG. 6. Upon deflecting the latch outwardly from its release position, the latch cam surfaces 94 engage their corresponding shroud guide surfaces 80. Continued outward deflection of the latch causes the latch and/or shroud components to deform allowing the corresponding bearing surfaces 82 and 96, respectively, of the shroud component 79 and latch 84 to engage. The latch is then in its release position where it is releasably maintained in compression between the shroud components and out of the path of a locking ear 52.

The insulative body 50 of plug 46, best shown in FIGS. 9–11, includes a connector portion 100 defining a trio of offset apertures 102 each having a funnel entry 104 opening onto an abutment surface 106 for engaging the receptacle end wall 70 thereby limiting insertion of the plug 46 into the receptacle. Each aperture 102 is aligned with a corresponding pin 44 held by the end wall, and each aperture holds a receiver 48, shown in FIG. 12, for mating with a corresponding pin 44 to complete an electrical circuit. It is noted that the walls 64, 66 and 68 of the receptacle housing 63 have a pair of inside lower rounded corners 108 and a pair of inside upper angled corners 110. Similarly, the plug connection portion 100 has a pair of outside rounded lower corners 112 and a pair of outside angled upper corners 114. Accordingly, for the plug connector portion 100 to be received in the housing 63, the plug must be oriented so that the apertures 102 are aligned with the pins 44.

The plug 46 also includes a handle portion 116 connected to the connector portion 100 and a cord collar 118 extending from the handle portion away from the connector portion. The collar holds a cord 120 having conductors electrically connected to corresponding receivers 48 inside the connector portion 100. The handle portion includes a series of spaced transverse ribs 122 on opposite sides thereof to permit the user to more firmly grasp the plug. It is noted that the handle portion extends outside of the receptacle shroud 76 when the plug is fully received into the cavity 56, as shown in FIG. 3.

As best shown in FIG. 9, each of the locking ears 52 of the plug connector portion 100 includes a leading ramp surface 124 which extends at an angle of about 30° with respect to the axial direction of the plug, a trailing abutment surface 126 which extends at about a 90° angle with respect to the axial direction of the plug and a crest surface 128 interconnecting the ramp surface 124 and the abutment surface 126 and extending generally parallel to the axial direction of the plug. The ramp surfaces 124 function to engage the inner surfaces 98 of distal end cross members 86 of the latches and to cause them to deflect toward their release positions allowing the plug 46 to be fully inserted into the cavity 56 of the receptacle 42 until the abutment surface 106 of the connector portion engages the end wall 70 of the housing 63, at which time the latches 84 have returned toward their locking positions and have captured the plug ears 52 in the latch windows 92. The abutment surface 126 of each locking ear operates to firmly engage the distal end cross member 86 after the ear has been received in the window 92 defined by each latch 84, thereby to prevent unintentional removal of the plug 46 from the receptacle 42.

Operation of the electrical connector system 40 with releasable latches of the present invention is as follows: As the connector portion 100 of the plug starts its insertion in its axial direction into the cavity 56, which extends from the receptacle housing end wall 70 to the open end 58 of the cavity 56, the connector portion can be freely received within the shroud because the dimensions are such that there need be no engagement of the connector portion with the latch member 84 until the locking ears 52 engage the distal end cross members 86 of the latches 84. When this occurs, the ramp surface 124 of each locking ear causes the corresponding latch 84 to deflect toward its release position. It is important to note that the ramp surfaces 124 do not extend sufficiently to cause the latches 84 to be fully moved to their release position so that they are held by the shroud components 79. With continued insertion, the latches 84 are spread sufficiently that they are engaged by the crest surfaces 128 of the locking ears 52. Upon continued insertion, the locking ears will move past the cross members 86 and into the windows 92 of the latches. At this time the latches, due to their resiliency, return to their locking positions thereby captively holding the plug 46 in the receptacle 42. Attempted pull out results in the abutment surfaces 126 of the ears 52 engaging the cross members 86 to prevent pull out. Due to the angle of the abutment surface 126 of the ears, there can be no camming apart of the latches. When plug removal is desired, the user simply pulls one of the latches 84 to its release position so that it is retained in an interference fit in the corresponding opening 78 in the shroud 76, with the shroud components 79 compressively maintaining the latch 84 in its release position. With one of the latches maintained out of the path of its corresponding ear, the user then deflects the remaining latch towards its release position, out of the path of its corresponding ear, and pulls the plug out of the receptacle. The latch held in its release position can be returned toward its locking position by merely pushing the latch inwardly. Thus, although the plug insulative body 50 is molded of a relatively soft, low tensile strength plastic and the receptacle body 54 is made of a relatively hard plastic, the components can be mated and securely locked without damaging the latching means carried by the soft plug.

Referring to FIG. 12, each receiver 48 includes a crimp portion 130 for receiving and holding the metallic core of one of the conductors in the cord 120. Connected to the crimp portion 130 is a female connector 132 made up of a floor 134, sides 136, and a ceiling 138 which is connected to one side 136 and extends downwardly toward the floor 134 and toward the other side 136. The distal end of the ceiling 138 carries a dependent leg 140 which extends alongside the other side 136 and bears against the floor 134. As the receiver 48 is formed from a blank of a resilient metallic material, such as a brass alloy, it will be apparent to one of skill in the art that the female connector 132 comprises a spring system including the ceiling 138. As the convergent leading end of the pin 44 is inserted into the female connector 132, the ceiling 138 is deflected away from the floor 134 and exerts a force pushing the pin 44 against the floor 134 thereby establishing good electrical contact therebetween.

In view of the above, it will be seen that the several objects of the invention are achieved and other advantageous results attained.

As various changes could be made without departing from the scope of the invention, it is intended that all matter contained in the above description shall be interpreted as illustrative and not in a limiting sense.

What is claimed is:

1. An electrical connector system with releasable latching, said system comprising:

a plug comprising an insulative body carrying at least one first terminal element connected to a conductor extending from the plug; and a receptacle having a body of insulative material defining a cavity having an open end for receiving said plug and having at least one second terminal element aligned for mating engagement with said first terminal element when said plug is received in said receptacle, said plug including a locking ear extending laterally relative to the axial direction of said plug, said receptacle having a cantilever latch extending alongside said plug and with the distal end of said latch being disposed past said ear, said latch including a window for receiving said ear to lock said plug to said receptacle, said latch being resilient and deflectable outwardly from a locking position wherein said latch holds said ear to a release position wherein said latch is disposed out of the path of said ear, said receptacle having means for receiving said latch in an interference fit releasably to hold said latch in its release position whereby said plug and receptacle can be disassociated without interference from said latch.

2. A connector system as set forth in claim 1 wherein said plug insulative body is made of a relatively soft plastic and said receptacle is made of a relatively hard plastic.

3. A connector system as set forth in claim 2 wherein said plug body is made of PVC and said receptacle body is made of nylon.

4. A connector system as set forth in claim 2 wherein said first terminal element is a female disconnect including a spring component, said second terminal element being a male disconnect, said plug body being molded about said female disconnect.

5. A connector as set forth in claim 1 wherein said ear has a leading ramp surface for deflecting said latch toward its release position and a trailing abutment surface for engaging said latch distal end to hold said plug and receptacle together.

6. A connector system as set forth in claim 1 wherein said receiving means comprises a shroud at least partially defining said cavity with said latch being positioned inwardly of said shroud, said shroud having an opening aligned with said latch and sized to receive said latch in an interference fit when said latch is moved to its release position.

7. A connector system as set forth in claim 6 wherein components of said shroud defining said opening have guide surfaces for engaging said latch and directing said latch into said aperture as said latch is moved toward its release position.

8. A connector system as set forth in claim 7 wherein said latch has cam surfaces engageable with said guide surfaces for camming apart said components as said latch is moved toward its release position.

9. A connector system as set forth in claim 1 wherein said receptacle includes a peripheral mounting flange and an end wall spaced from said flange and carrying said second terminal element, said cavity extending from said end wall to said open end.

10. A connector system as set forth in claim 9 wherein said plug body includes a connector portion for engagement with said end wall to limit insertion of said plug into said receptacle, said plug further having a handle portion disposed outside said receptacle when said connector portion is fully inserted.

11. A connector system as set forth in claim 10 wherein said plug includes a pair of spaced locking ears and wherein said receptacle includes a corresponding pair of said cantilever latches whereby after moving one of said latches to its release position where it is held by said receiving means, the user can deflect the remaining latch towards its release position with one hand and pull said plug from said receptacle with the other hand.

12. A connector system as set forth in claim 9 wherein the connected end of said latch is disposed adjacent said flange and the distal end of said latch terminates adjacent the open end of said cavity.

13. An electrical connector system with releasable latching, said system comprising:

a plug comprising an insulative body formed of a relatively soft plastic and carrying at least one female terminal element connected to a conductor extending from the plug; and a receptacle having an insulative body formed of relatively hard plastic and defining a cavity having an open end for receiving said plug, said receptacle including at least one male terminal element aligned for mating engagement with said female terminal element when said plug is received in said receptacle, said plug including a locking ear extending laterally relative to the axial direction of said plug, said receptacle having a cantilever latch extending alongside said plug and with the distal end of said latch being disposed past said ear, said latch including a window for receiving said ear to lock said plug to said receptacle, said latch being resilient and deflectable outwardly from a locking position wherein said latch holds said ear to a release position wherein said latch is disposed out of the path of said ear, said receptacle having means integral with said receptacle body for releasably holding said latch in its release position.

14. A connector system as set forth in claim 13 wherein said means for releasably holding comprises a shroud at least partially defining said cavity and having an aperture for receiving said latch in an interference fit, said latch when in its locking position being disposed inwardly of said shroud.

* * * * *